US005180162A

United States Patent [19]

Browne

[11] Patent Number: 5,180,162

[45] Date of Patent: Jan. 19, 1993

[54] GOLF HOLE COLLAR

[76] Inventor: Richard P. Browne, 26 Lazy La., The Woodlands, Tex. 77380

[21] Appl. No.: 766,056

[22] Filed: Sep. 26, 1991

[51] Int. Cl.[5] ..... A63B 57/00

[52] U.S. Cl. ..... 273/34 R; 273/DIG. 24

[58] Field of Search ..... 273/34 R, 34 A, 34 B, 273/DIG. 24, 178 R, 178 A, 178 B

[56] References Cited

U.S. PATENT DOCUMENTS

| | | | |
|---|---|---|---|
| 1,813,696 | 7/1931 | Crocker | 273/34 R |
| 4,108,439 | 8/1978 | McGuire | 273/176 R |
| 4,280,698 | 7/1981 | Troiano | 273/34 B |
| 4,878,665 | 11/1989 | Boudreau et al. | 273/34 R |
| 4,900,023 | 2/1990 | Gelina | 273/34 B |
| 5,029,856 | 7/1991 | Bookspan | 273/34 R |

*Primary Examiner*—George J. Marlo

*Attorney, Agent, or Firm*—Payne Alton W.

[57] ABSTRACT

A simple, brightly colored, plastic collar is disclosed for greatly enhancing the visibility of the golf hole for players, spectator and televised golf events. The collar has a diameter essentially the same as a regulation hole and is installed in the cup adjacent the exposed earth wall between the lip of the hole and the hole liner. Furthermore, use of the collar enhances a retention of moisture in the earth around the lip to prevent drying and crumbling of the soil which can cause an initially sharp lip to become rounded. The collar preferably has tabs extending upwardly along the upper perimeter to insure that the reaction of an impinging golf ball against the cup wall having the collar installed is not substantially altered from the reaction of a ball impinging an earth surface of a cup not having the collar installed.

5 Claims, 3 Drawing Sheets

GOLF HOLE COLLAR

FIELD OF THE INVENTION

The present invention relates to the game of golf. More particularly, the present invention relates to an internal collar device for enhancing the visibility of a golf hole when a player is hitting a golf ball as well as maintaining the initial characteristics of the golf hole.

BACKGROUND OF THE INVENTION

To prepare natural grass golf greens for play, the greens are cored with an auger to create a regulation 4.25 inch diameter hole. A hard plastic liner is typically inserted to preserve the shape of the hole and hold a flag. Since proper putting velocity is a honed skill and because a ball stroked with excessive velocity may strike the back side of the hole and bounce out, it is undesirable that the ball strike hard plastic which is a relatively elastic surface compared to bare earth. Therefore, the cup liner is generally set about 1 to 1.5 inches beneath the grass surface leaving a bare earth strip. This earth surface at the top portion of the hole upholds traditional elements of the game and prevents a ball from bouncing out of the hole in an unwarranted fashion.

There are two main problems observed in the typical golf course which are solved by the present invention. Firstly, a natural colored background gives the hole relatively low visibility to greens players some yards distant from the cup. Lower visibility can increase a player's difficulty and worsen his score. Spectators both at the course and over a television broadcast also generally have difficulty seeing the hole. Such difficulities can reduce the pleasure of the event.

To overcome this basic difficulty, a golfer may typically use a person to "spot the cup" by holding the flag in place until the ball is struck. In televised tournament play, the exposed earth may be coated with white latex paint. However, this procedure requires a special paint spraying apparatus which is expensive, time consuming to use and the paint flakes off over time and use.

A second well known difficulty results when the exposed earth portion of the hole drys out during the day and gets trodden. The hole lip, originally sharp, can become rounded as the soil drys and crumbles and wears from play. This may present players at the end of the day with greater (but unfair) opportunity to get a ball, which might otherwise hang on the lip, to drop in the hole. This is particularly a problem for golf courses which do not relocate each hole every day.

U.S. Pat. No. 4,108,439 to McGuire describes a protector and marker device for an imbedded sprinkler head as might be found on a large lawn including golf courses. The device is tubular shaped with a flange ring attached to the outer edge. The device is forced into the ground surrounding the sprinkler head. The ring acts to mark the sprinkler head and limits the depth of the insertion. The ring can include indicia indicating the distance from the cup when used on golf courses.

U.S. Pat. No. 4,280,698 to Troiano describes a putting aid and golf cup cover device. This device is designed to be used during practice sessions to improve one's putting accuracy. By reducing the diameter of the cup and simulating artificial grass on the cup lip, a player will increase his putting accuracy. This device uses flexible finger members against the inside of the cup to secure a position over the cup.

U.S. Pat. No. 4,878,665 to Boudreau et al. describes a golf cup unit having an insert disc mounted within the cup at the bottom thereof and twist-on connections for attaching the disc to the cup unit. Advertisements can be printed on an upper face of the disc for viewing by a golfer after the flag is removed.

U.S. Pat. No. 4,900,023 to Gelina describes a golf putting aid made from a cylindrical insert made from spongy rubber material fitted at the top of the cup. The device is designed to reduce the diameter of the cup to force a player to have greater putting accuracy.

U.S. Pat. No. 5,029,856 to Bookspan describes a golf cup for artificial greens comprising a golf cup having an inserted cylindrical layer of a compressible substance (e.g. rubber) secured to the upper end of the cup. The layer is said to closely approximate the frictional contact between a golf ball and the grass/root transition area of a real grass golf hole.

It is, therefore, a feature of the present invention to provide a golf hole collar which in normal use provides high visibility while improving both the hole conditions and performance of the golfer.

A feature of the present invention is to provide a golf hole collar which improves the consistency of golf hole characteristics.

Another feature of the present invention is to provide a golf hole collar which reduces golf course maintenance costs.

Another feature of the present invention is to provide a golf hole collar which improves golf hole visibility for players, spectators and the television coverage of golfing events.

Another feature of the present invention is to provide a golf hole collar which is inexpensive, simple to use and stays firmly in place.

Yet another feature of the invention is to provide a golf hole collar which does not change the dimensions of the golf hole itself.

Still another feature of the invention is to provide a golf hole collar which does not change the compression characteristics of the golf hole itself.

Another feature of the present invention is to provide a golf hole collar which assists in holding the shape of the hole.

Another feature of the present invention is to provide a golf hole collar which prevents the hole from collapsing.

Yet another feature of the present invention is to provide a golf hole collar which acts as a "target" which is highly visible to the golfer.

Still another feature of the present invention is to provide a golf hole collar which is easily installed without any special tools.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

A simple brightly colored plastic collar device installed adjacent an exposed earth wall between a lip of a golf course hole and a golf hole liner greatly enhances the visibility of the hole for players and spectators.

Furthermore, use of the collar enhances the retention of moisture in the earth around the lip to prevent drying and crumbling of the soil which can cause an initially sharp lip to become rounded.

In one embodiment, the present invention provides a device for increasing the visibility of a golf hole installed adjacent an earthen strip between a lip of the hole and a golf liner, comprising a brightly colored, cylindrical collar having upper and lower perimeters and an outside diameter essentially the same as the inside diameter of the golf hole. The collar preferably imparts an absence of elastic reaction to an impinging golf ball, is sufficiently stiff to retain the regulation diameter, is sufficiently flexible to permit temporary collapse of the diameter for insertion and removal from the hole and comprises a moisture barrier.

In another embodiment, the collar has a plurality of tabs extending upwardly around the upper perimeter which enhances the flexibility of the collar for reducing the potential elastic response of an impinging golf ball.

The collar is preferably made from a thermoplastic or elastomeric material which has a yellow, orange, red or white color.

BRIEF DESCRIPTION OF THE DRAWINGS

The accompanying drawings which are incorporated in and constitute a part of the specification, illustrate a preferred embodiment of the invention and together with the general description of the invention given above and the detailed description of the preferred embodiment given below, serve to explain the principles of the invention.

The above general description and the following detailed description are merely illustrative of the generic invention, and additional modes, advantages, and particulars of this invention will be readily suggested to those skilled in the art without departing from the spirit and scolpe of the invention.

DETAILED DESCRIPTION OF THE PREFERRED EMBODIMENTS

Reference will now be made in detail to the present preferred embodiments of the invention as described in the accompanying drawings.

A flexible, brightly colored collar installed in a golf hole adjacent the bare earth section at the top of the hole presents an excellent visual target for players, spectators and televised matches. The collar is made from soft plastic in a manner which does not substantially change the elastic response of the impinging ball compared to bare earth. The collar is easy to install and keep in place.

Figure 1:
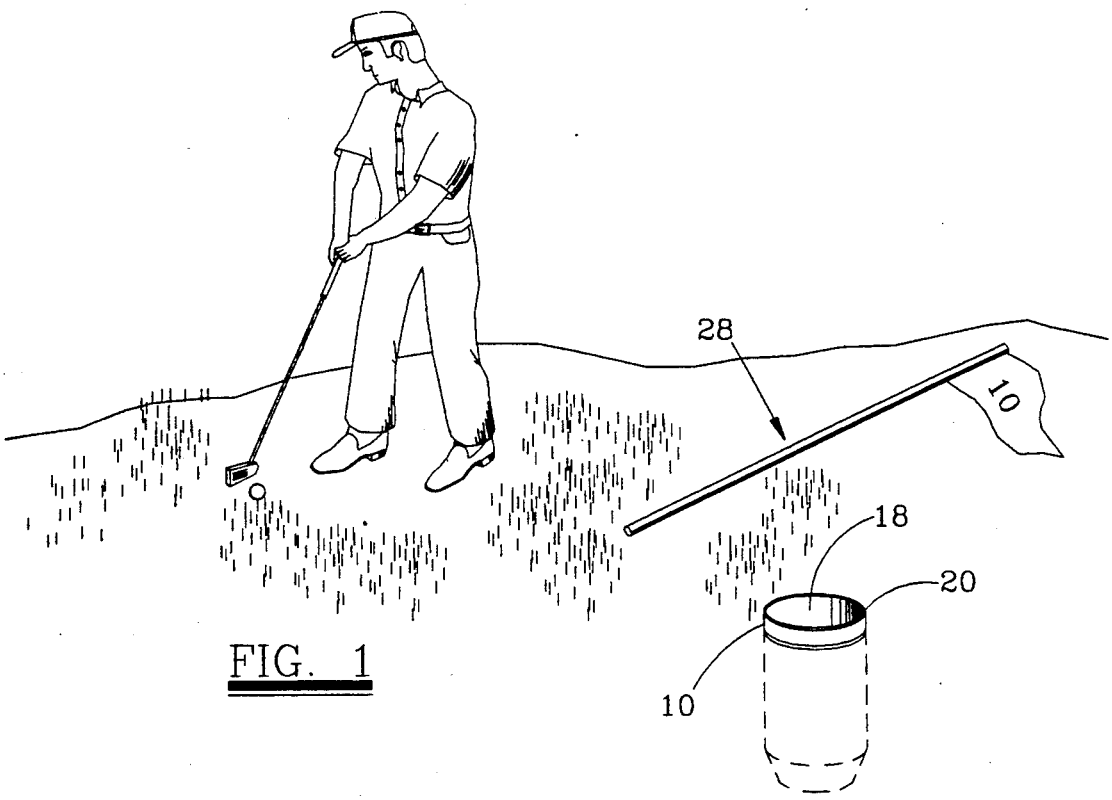
FIG. 1 is a perspective view of the present invention being used on a golf course.
Figure 2:
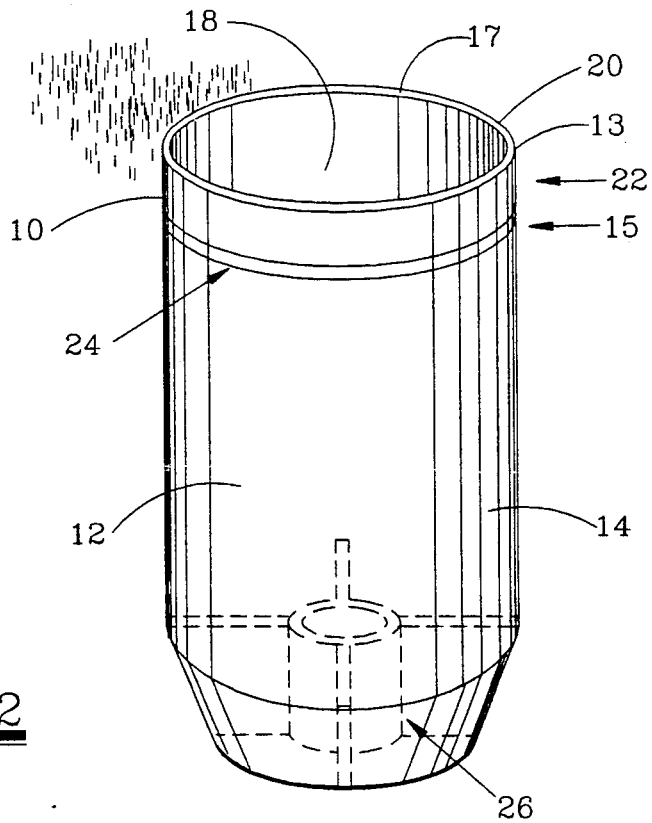
FIG. 2 is a perspective close-up view of a cup seen in FIG. 1 showing the present invention installed therein.
Figure 3:
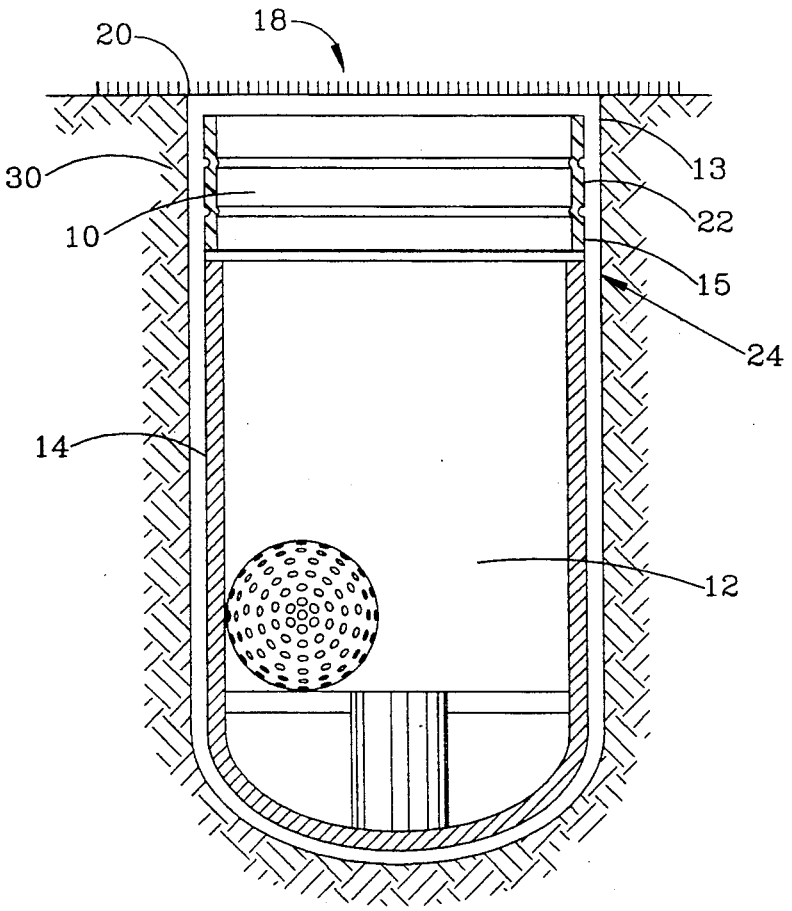
FIG. 3 is a cross-sectional view of the cup showing the present invention installed therein.

Referring to FIGS. 1 and 2, a golfer putting a golf ball on a golf green some yards distant from a golf cup 12 has a good visibility target to aim for because a brightly colored collar 10 of the present invention is installed in the cup 12 above a liner 14 but below a lip 20 of a hole 18 defined by the cup 12. The liner 14 is typically used to give integrity to the hole 18 and provide a stand 26 for a flag 28. Therefore, the liner is preferably made from hard plastic or metal.

Referring to FIGS. 2, 3, 4 and 6, the present invention comprises a flexible, brightly colored, cylindrical collar 10 having an upper perimeter 13, a lower perimeter 15 and an inside diameter at the upper perimeter 13 which is essentially the same as a regulation golf hole, about 4.25 inches. The collar 10 preferably has an overall outside diameter the same as the support liner 14.

The collar 10 is installed in a position around the top side 22 of the golf cup 12 adjacent an otherwise exposed earth wall 30 between the lip 20 of the hole 18 and the liner 14. A preferred collar 10 has a side length defined by the upper perimeter 13 and the lower perimeter 15 extending from a top edge 24 of the liner 14 to a position approximately $\frac{1}{8}$ to $\frac{1}{4}$ inch beneath the lip 20. The liner 14 can be conveniently used to support the collar 10 at the lower perimeter 15.

Bright color is an essential property of the collar 10. Examples of useful high visibility colors include yellow, orange, red, white and the like. Such colors may have various shades and attributes for different applications such as fluorescence.

As another important property, the top of the collar 10 has an elasticity similar to that of the bare earth. Alternatively, the collar 10 has a thin wall 17 or is made from a relatively soft material so that the elasticity of the collar 10 is minor in comparison to the adjacent earth surface 30. It is desirable that the present invention not substantially alter the reaction of a golf ball inpinging the side 22 of the cup 12 having the collar 10 installed over the reaction of the ball impinging the ordinary earth surface 30.

As a further property, the collar 10 is relatively stable or springy to retain the regulation diameter and position in the cup. Such stiffness can be conventionally obtained by various means including increasing the wall thickness 17 in the lower perimeter 15.

In addition, the collar 10 provides a nominal moisture barrier reducing an ordinary rate of moisture loss from the earth surface 30 to the air.

In a preferred embodiment, the collar 10 has tabs 16 extending upwardly around an upper perimeter 13. Tabs 16 can be used to further reduce the elastic response of the collar 10 and to frictionally engage the earth surface 30 to prevent any movement of the installed collar 10 when struck by a golf ball.

The collar 10 of the present invention may be made from thermoplastic or elastomeric materials, for example. Such materials include low density polyethylene, polystyrene, synthetic rubber, and the like which are readily available commercially.

Figure 4:
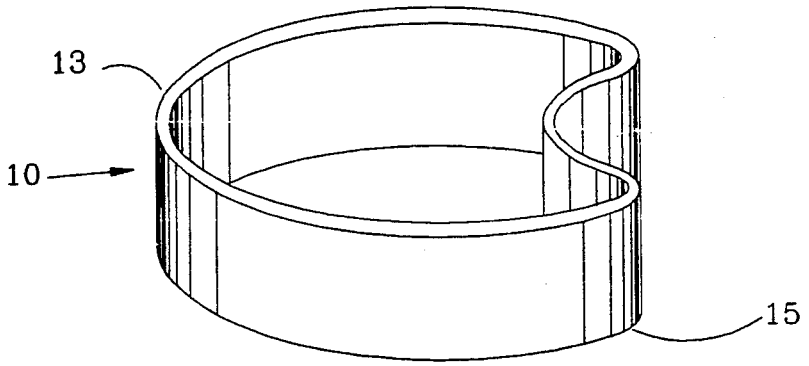
FIG. 4 is a perspective view showing the flexibility of the present invention prior to installation.

Installation (and removal) of the collar 10 is easily made by partially collapsing one side of the collar to reduce the overall diameter, as illustrated in FIG. 4, then returning the deflected side to its normal undeflected state once positioned in the hole. For an elastic collar, the deflected side would normally return to an undeflected state when the force causing the defection is removed.

Figure 5:
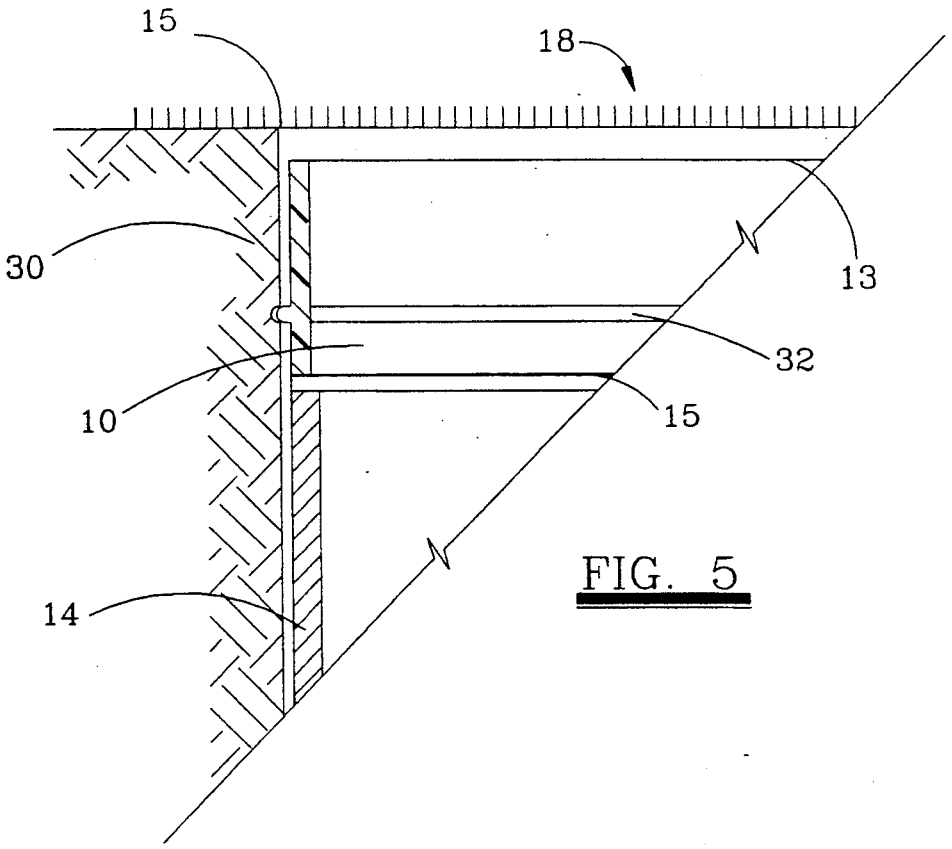
FIG. 5 is a cut-away view showing the engagement between the soil and the upper portion of the present invention after installation.
Figure 6:
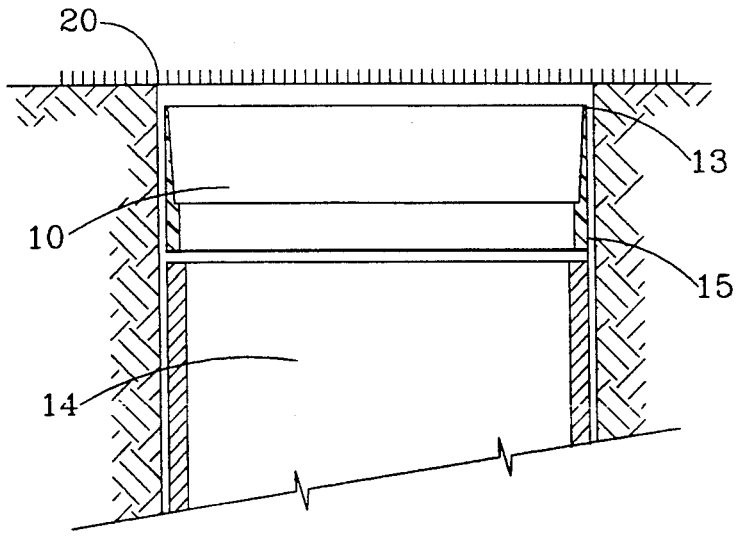
FIG. 6 is a cross-sectional view of the cup showing the present invention installed therein.

FIG. 5 demonstrates, by enlargement, several additional features of the present invention. An indentation 31 in the collar 10 assures an easy outward flex or force by the tabs 16 to assure no resistance greater than the earth 30 exists in the upper portion of the golf hole. The outward flex or force of the tabs 16 prevents an unnatural bounce, which is not desirable. The indentation 31 does not compromise nor reduce the desirable stability of the tabs 16 in resisting forces from the outside of the collar 10 inward.

FIG. 5 illustrates a circumferential "welt" 32 around the collar 10 which will anchor the collar into place by simply compressing into the side of the exposed earth 30 of the golf hole 18. When the collar is inserted into the hole 18 and resumes its present circular shape.

Modifications of the shown solution are of course within the scope of the inventor and manufacturer of the invention such that the product characteristics are assured.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

What is claimed is:

1. A device for increasing the visibility of a golf putting hole in a natural grass putting green and adapted to be installed against the earth extending between the upper lip of the hole and the upper edge of the recessed liner in said hole, comprising a brightly colored, cylindrical collar having upper and lower perimeters, a height slightly less than the distance between said lip and said upper edge of the hole liner, and an inside diameter essentially the same as a regulation golf hole diameter, the properties of said collar being such as to impart an absence of elastic reaction to an impinging golf ball and sufficiently stiff to retain the regulation diameter and sufficiently flexible to permit the temporary collapse of its diameter, and said collar having tab members extending upwardly around said upper perimeter.

2. A device as described in claim 1 wherein the upper circumferential section is constructed of upwardly extending rhombohedral shaped prongs, having generally square tips and triangular shaped, vertical perforations separating said prongs.

3. A device as described in claim 1 wherein the lower circumferential section is constructed of a solid band of material.

4. A device as described in claim 1 wherein said collar is constructed of non-porous material that will seal the exposed earthen annulus between the cup liner and the surface lip of the golf green hole.

5. A device as described in claim 1 including an anchor welt on the earth engaging side of the collar.

* * * * *